US012082763B2

(12) United States Patent
Karlsson

(10) Patent No.: US 12,082,763 B2
(45) Date of Patent: Sep. 10, 2024

(54) VACUUM CLEANER BRUSH ROLL AND VACUUM CLEANER

(71) Applicant: Aktiebolaget Electrolux, Stockholm (SE)

(72) Inventor: Roger Karlsson, Stockholm (SE)

(73) Assignee: Aktiebolaget Electrolux, Stockholm (SE)

( * ) Notice: Subject to any disclaimer, the term of this patent is extended or adjusted under 35 U.S.C. 154(b) by 518 days.

(21) Appl. No.: 17/299,518

(22) PCT Filed: Dec. 7, 2018

(86) PCT No.: PCT/EP2018/083904

§ 371 (c)(1),
(2) Date: Jun. 3, 2021

(87) PCT Pub. No.: WO2020/114605

PCT Pub. Date: Jun. 11, 2020

(65) Prior Publication Data

US 2022/0053984 A1 Feb. 24, 2022

(51) Int. Cl.
*A47L 9/04* (2006.01)
*A46B 9/02* (2006.01)
(Continued)

(52) U.S. Cl.
CPC ..... *A47L 9/0477* (2013.01); *A47L 9/04* (2013.01); *A46B 9/02* (2013.01); *A46B 9/06* (2013.01); *A46B 13/001* (2013.01)

(58) Field of Classification Search
CPC ..... A47L 9/0477; A47L 9/04; A47L 11/4041; A47L 9/0411
See application file for complete search history.

(56) References Cited

U.S. PATENT DOCUMENTS 2,459,007 A 1/1949 Taylor
8,806,710 B2 8/2014 Follows et al.
(Continued)

FOREIGN PATENT DOCUMENTS

CN 206534590 U 10/2017
CN 108903823 A 11/2018
(Continued)

OTHER PUBLICATIONS

Chinese Decision of Rejection for Chinese Application No. 201880100052.2, issued Mar. 29, 2023 with translation, 21 pages.
(Continued)

*Primary Examiner* — David Redding
(74) *Attorney, Agent, or Firm* — Bradley Arant Boult Cummings LLP

(57) ABSTRACT

A vacuum cleaner brush roll having a brush body arranged to rotate around an axis (ax), a first row of bristles arranged on a first axial half section of the brush body along a first helix around the axis (ax), and a second row of bristles arranged on a second axial half section of the brush body along a second helix around the axis (ax). The twist of the second helix is opposite to the twist of the first helix. The first row of bristles comprises a first type of bristles and the second row of bristles comprises a second type of bristles having different characteristics than the first type of bristles. The present disclosure further relates to vacuum cleaner comprising a brush roll.

19 Claims, 2 Drawing Sheets

(51) Int. Cl.
*A46B 9/06* (2006.01)
*A46B 13/00* (2006.01)

(56) References Cited

U.S. PATENT DOCUMENTS

| | | | |
|---|---|---|---|
| 2014/0259522 | A1 | 9/2014 | Kasper et al. |
| 2014/0331446 | A1 | 11/2014 | Eriksson |
| 2016/0220080 | A1 | 8/2016 | Thorne |
| 2016/0220083 | A1 | 8/2016 | Thorne et al. |
| 2016/0367096 | A1 | 12/2016 | Kasper et al. |

FOREIGN PATENT DOCUMENTS

| | | | |
|---|---|---|---|
| CN | 111938503 | A | 11/2020 |
| GB | 2482227 | A | 1/2012 |
| GB | 2588158 | A | 4/2021 |
| JP | 5235184 | U | 3/1977 |
| JP | 2000354569 | A | 12/2000 |
| JP | 2006325761 | A | 12/2006 |
| JP | 2013116355 | A | 6/2013 |
| JP | 2018503473 | A | 2/2018 |
| KR | 20160136360 | A | 11/2016 |
| WO | 2015140510 | A1 | 9/2015 |
| WO | 2016123345 | A1 | 8/2016 |

OTHER PUBLICATIONS

Korean Office Action for Korean Application No. 10-2021-7016557, dated Apr. 25, 2023, with translation, 6 pages.

Japanese Reconsideration Report by Examiner before Appeal for Japanese Application No. 2021-531227, dated May 15, 2023 with translation, 4 pages.

International Search Report and Written Opinion for International Application No. PCT/EP2018/083904, dated Aug. 21, 2019, 10 pages.

Japan Patent Office, Japanese Application No. 2021-531227, "Non-Final Notice of Reasons for Rejection," dated Mar. 12, 2024, 4 pages.

VACUUM CLEANER BRUSH ROLL AND VACUUM CLEANER

This application is a U.S. National Phase application of PCT International Application No. PCT/EP2018/083904, filed Dec. 7, 2018, which is incorporated by reference herein.

TECHNICAL FIELD

The present disclosure relates to a vacuum cleaner brush roll arranged to rotate around an axis during operation. The present disclosure further relates to a vacuum cleaner comprising a brush roll.

BACKGROUND

A vacuum cleaner is a device that uses an air pump, most often a centrifugal fan, to create a partial vacuum in order to suck up dust and dirt from surfaces, such as floors, carpets, and the like. Some vacuum cleaners are equipped with a brush roll which is rotated during operation of the vacuum cleaner. A brush roll can improve the cleaning efficiency because bristles of the brush roll can remove particles, dust, and dirt from the surface by an abutting contact against the surface.

In general, some problems and requirements exist when designing vacuum cleaners and vacuum cleaner components. One example, which already is indicated above, is the cleaning efficiency. Users of vacuum cleaners expect a high cleaning efficiency in order to achieve a good cleaning result with little effort. Another problem is noise level during operation. Noise generated by a vacuum cleaner is usually annoying for the user and for persons in the vicinity of the vacuum cleaner. Still another problem is to provide a user-friendly vacuum cleaner which can be used in a simple and intuitive manner.

Moreover, generally, on today's consumer market, it is an advantage if products, such as vacuum cleaners and vacuum cleaner components, have conditions and/or characteristics suitable for being manufactured and assembled in a cost-efficient manner.

SUMMARY

It is an object of the present invention to overcome, or at least alleviate, at least some of the above-mentioned problems and drawbacks.

According to a first aspect of the invention, the object is achieved by a vacuum cleaner brush roll comprising a brush body arranged to rotate around an axis, a first row of bristles arranged on a first axial half section of the brush body along a first helix around the axis, and a second row of bristles arranged on a second axial half section of the brush body along a second helix around the axis, wherein the twist of the second helix is opposite to the twist of the first helix. The first row of bristles comprises a first type of bristles and the second row of bristles comprises a second type of bristles having different characteristics than the first type of bristles.

Since the twist of the second helix is opposite to the twist of the first helix, a brush roll is provided in which particles, dust, and debris are displaced to, and collected at, predefined portions of the brush roll. That is, by rotating the brush roll in a first rotational direction, the particles, dust, and debris can be displaced to, and collected at, a centre portion of the brush roll. Thereby, when the brush roll is arranged in a vacuum cleaner having a suction inlet nozzle at the centre portion of the brush roll, the cleaning efficiency of the vacuum cleaner is improved. Furthermore, by rotating the brush roll in a second rotational direction, opposite to the first rotational direction, the particles, dust, and debris can be displaced to, and collected at, a respective end portion of the brush roll. In this manner, when the brush roll is arranged in a vacuum cleaner having one suction inlet nozzle at each end portion of the brush roll, the cleaning efficiency of the vacuum cleaner is improved.

Moreover, since the first row of bristles comprises a first type of bristles and since the second row of bristles comprises a second type of bristles having different characteristics than the first type of bristles, a brush roll is provided which improves user-friendliness of a vacuum cleaner comprising the brush roll. This because the brush roll can be used on a first type of surface on which the first type of bristles is best suited for cleaning, as well as on a second type of surface on which the second type of bristles is best suited for cleaning, without having to interrupt the cleaning procedure, for example by switching a lever on the vacuum cleaner, or a lever on a cleaning nozzle of the vacuum cleaner.

Accordingly, a brush roll is provided overcoming, or at least alleviating, at least some of the above-mentioned problems and drawbacks. As a result, the above-mentioned object is achieved.

Optionally, the second type of bristles is softer than the first type of bristles. Since the second type of bristles is softer than the first type of bristles, the second type of bristles is better suited to clean hard surfaces, such as floor surfaces, and the like, than the first type of bristles. Conversely, because the first type of bristles is harder than the second type of bristles, the first type of bristles is better suited to clean softer surfaces, such as carpets, and the like, than the second type of bristles. Accordingly, because the brush roll comprises both softer and harder types of bristles, a versatile brush roll is provided which can be used on harder surfaces as well as on softer surfaces without having to interrupt the cleaning procedure, for example by switching a lever on the vacuum cleaner, or a lever on a cleaning nozzle of the vacuum cleaner.

Optionally, the second type of bristles extends further from the axis than the first type of bristles. Since the second type of bristles extends further from the axis than the first type of bristles, the second type of bristles is better suited to clean hard surfaces, such as floor surfaces, and the like, than the first type of bristles. Conversely, because the first type of bristles extends a shorter distance from the axis than the second type of bristles, the first type of bristles is better suited to clean softer surfaces, such as carpets, and the like, than the second type of bristles. Moreover, when cleaning softer surfaces, such as carpets, the bristles of the second type will bend to allow bristles of the first type to reach the soft surface. Accordingly, a versatile brush roll is provided which can be used on harder surfaces and softer surfaces without having to interrupt the cleaning procedure, for example by switching a lever on the vacuum cleaner, or a lever on a cleaning nozzle of the vacuum cleaner.

Optionally, the brush roll is arranged to rotate in an intended rotational direction causing intersection points between portions of the first and second rows of bristles and a stationary plane comprising the axis to move towards a separation plane between the first and second axial half sections when the brush roll is rotating around the axis in the intended rotational direction. Thereby, by rotating the brush roll in intended rotational direction, particles, dust, and debris will be displaced to, and collected at, a centre portion of the brush roll. Thereby, the cleaning efficiency is improved, and conditions are provided for a vacuum cleaner having a suction inlet nozzle at the centre portion of the brush roll. Moreover, in this manner, conditions are provided for a vacuum cleaner having conditions and characteristics suitable for being manufactured and assembled in a cost-efficient manner.

Optionally, the second row of bristles adjoins the first row of bristles. Thereby, the cleaning efficiency is further improved. This because the bristles will cover substantially the entire length of the brush body and because of the fact that bristles of the first and second row of bristles, at the centre portion of the brush roll, may assist displacement of particles, dust, and debris from the surface being cleaned towards a suction inlet of the vacuum cleaner.

Optionally, the brush roll further comprises a third row of bristles arranged on the first axial half section along a third helix around the axis, and a fourth row of bristles arranged on the second axial half section along a fourth helix around the axis, and wherein the twist of the fourth helix is opposite to the twist of the first and third helixes. The fact that the twist of the fourth helix is opposite to the twist of the first and third helixes and the twist of the second helix is opposite to the twist of the first helix implies that the twist direction of the first and third row of bristles arranged on the first axial half section are the same, and that the twist direction of the second and forth row of bristles arranged on the second axial half section are the same. In this manner, the cleaning efficiency is improved, and a brush roll is provided in which particles, dust, and debris are displaced to, and collected at, predefined portions of the brush roll.

Optionally, the bristles of the third row of bristles are arranged half a turn from the bristles of the first row of bristles in a plane perpendicular to the axis, and wherein the bristles of the fourth row of bristles are arranged half a turn from the bristles of the second row of bristles in a plane perpendicular to the axis. In this manner, the noise generated by the bush roll is lowered, and the cleaning efficiency is further improved.

Optionally, each of the first, second, third and fourth rows of bristles twists approximately half a turn around the axis along their respective extension. Thereby, the noise generated by the bush roll is further lowered. Moreover, the cleaning efficiency is further improved. This because two portions of row of bristles will continuously face a surface to be cleaned during rotation of the brush roll. As a further result thereof, the brush roll will provide a smooth and equal resistance torque during operation of the brush roll.

Optionally, the third row of bristles comprises the second type of bristles, and the fourth row of bristles comprises the first type of bristles. Thereby, the noise generated by the bush roll is further lowered. This because one portion of a row of bristles comprising the first type of bristles and one portion of a row of bristles comprising the second type of bristles will continuously face a surface to be cleaned during rotation of the brush roll. As a further result thereof, the brush roll will provide a smooth and equal resistance torque during operation thereof. Moreover, the cleaning efficiency is further improved. This because a portion of a surface, such as a floor surface or a carpet, will periodically be faced with bristles of the first type as well as bristles of the second type.

According to a second aspect of the invention, the object is achieved by a vacuum cleaner comprising a brush roll according to some embodiments of the present disclosure. Since the vacuum cleaner comprises a brush roll according to some embodiments, a user-friendly vacuum cleaner is provided having improved cleaning efficiency.

Accordingly, a vacuum cleaner is provided overcoming, or at least alleviating, at least some of the above-mentioned problems and drawbacks. As a result, the above-mentioned object is achieved.

Optionally, the vacuum cleaner comprises a motor arranged to rotate the brush roll around the axis. Thereby, a vacuum cleaner is provided ensuring rotation of the brush roll during operation of the vacuum cleaner.

Further features of, and advantages with, the present invention will become apparent when studying the appended claims and the following detailed description.

BRIEF DESCRIPTION OF THE DRAWINGS

Various aspects of the invention, including its particular features and advantages, will be readily understood from the example embodiments discussed in the following detailed description and the accompanying drawings, in which.

DETAILED DESCRIPTION

Aspects of the present invention will now be described more fully. Like numbers refer to like elements throughout. Well-known functions or constructions will not necessarily be described in detail for brevity and/or clarity.

Figure 1:
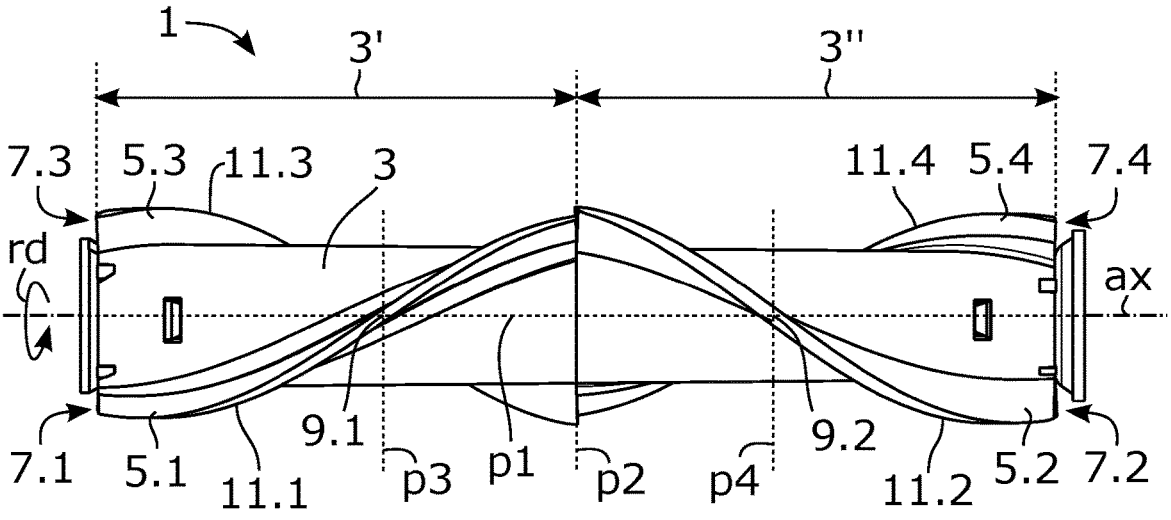
FIG. 1 illustrates a vacuum cleaner brush roll, according to some embodiments.

FIG. 1 illustrates a vacuum cleaner brush roll 1, according to some embodiments. For the reason of brevity and clarity, the vacuum cleaner brush roll 1 is in some places herein referred to as "the brush roll 1". The brush roll 1 comprises a brush body 3 arranged to rotate around an axis ax. According to the illustrated embodiments, the brush body 3 is cylindrical, wherein the axis ax coincides with a centre axis of the cylindrical brush body 3. The brush body 3 comprises a first axial half section 3' and a second axial half section 3", which, as explained below, may comprise a respective separate part which may be assembled in an assembling process of the brush roll 1.

The brush roll 1 comprises a first row of bristles 5.1 arranged on the first axial half section 3' of the brush body 3 along a first helix 7.1 around the axis ax. Moreover, the brush roll 1 comprises a second row of bristles 5.2 arranged on a second axial half section 3" of the brush body 3 along a second helix 7.2 around the axis ax. As can be seen in FIG. 1, the twist of the second helix 7.2 is opposite to the twist of the first helix 7.1. Moreover, as is further explained below, the first row of bristles 5.1 comprises a first type of bristles 11.1 and the second row of bristles 5.2 comprises a second type of bristles 11.2 having different characteristics than the first type of bristles 11.1.

According to the illustrated embodiments, the brush roll 1 is arranged to rotate in an intended rotational direction rd causing intersection points 9.1, 9.2 between portions of the first and second rows of bristles 5.1, 5.2 and a stationary plane p1 comprising the axis ax to move towards a separation plane p2 between the first and second axial half sections 3', 3" when the brush roll 1 is rotating around the axis ax in the intended rotational direction rd. Thereby, during operation of the brush roll 1, particles, dust, and debris will move towards the separation plane p2, i.e. to the centre portion of the brush roll 1.

Moreover, according to the illustrated embodiments, the brush roll 1 further comprises a third row of bristles 5.3 arranged on the first axial half section 3' along a third helix 7.3 around the axis ax, and a fourth row of bristles 5.4 arranged on the second axial half section 3" along a fourth helix 7.4 around the axis ax. As can be seen in FIG. 1, the twist of the fourth helix 7.4 is opposite to the twist of the first and third helixes 7.1, 7.3. Accordingly, the twist direction of the first and third row of bristles 5.1, 5.3 arranged on the first axial half section 3' are the same, and that the twist direction of the second and forth row of bristles 5.2, 5.4 arranged on the second axial half section 3" are the same. Thereby, during rotation of the brush roll 1 in the intended rotational direction rd, particles, dust, and debris will move towards the separation plane p2 between the first and second axial half sections 3', 3", i.e. to the centre portion of the brush roll 1.

According to the illustrated embodiments, each of the first, second, third and fourth rows of bristles 5.1, 5.2, 5.3, 5.4 twists approximately half a turn around the axis ax along their respective extension. Moreover, the second row of bristles 5.2 adjoins the first row of bristles 5.1 at the separation plane p2 between the first and second axial half sections 3', 3", and together form a V-formation at the separation plane p2. Likewise, the third row of bristles 5.3 adjoins the fourth row of bristles 5.4 at the separation plane p2 between the first and second axial half sections 3', 3", and together form a V-formation at the separation plane p2.

Figure 2:
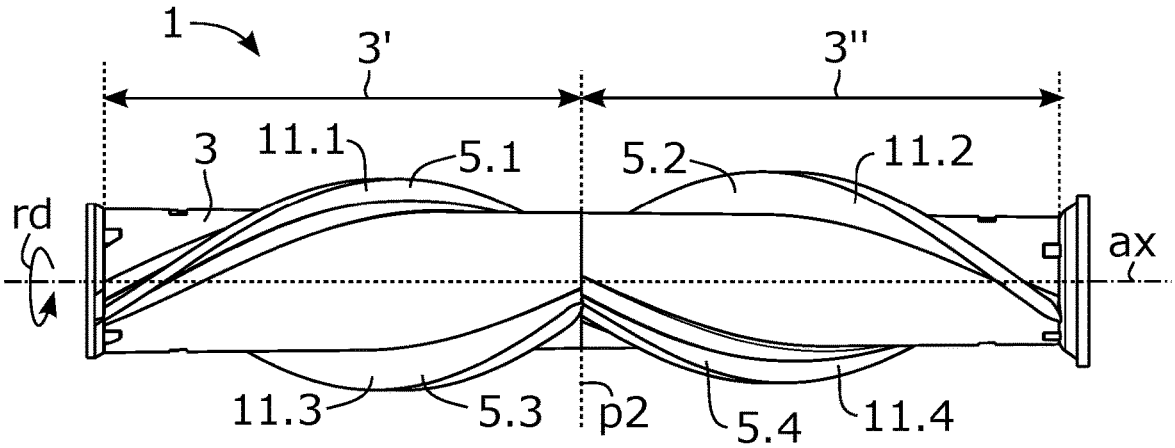
FIG. 2 illustrates the brush roll illustrated in FIG. 1, in another rotational position.

FIG. 2 illustrates the brush roll 1 illustrated in FIG. 1, in another rotational position. As mentioned above, and as is visible in FIG. 2, the third row of bristles 5.3 adjoins the fourth row of bristles 5.4 at the separation plane p2 between the first and second axial half sections 3', 3", and together form a V-formation at the separation plane p2.

As can be seen in FIG. 1 and in FIG. 2, and as is indicated in FIG. 1, the bristles 11.3 of the third row of bristles 5.3 are arranged half a turn from the bristles 11.1 of the first row of bristles 5.1 in a plane p3 perpendicular to the axis ax. Likewise, the bristles 11.4 of the fourth row of bristles 5.4 are arranged half a turn from the bristles 11.2 of the second row of bristles 5.2 in a plane p4 perpendicular to the axis ax.

Figure 3:
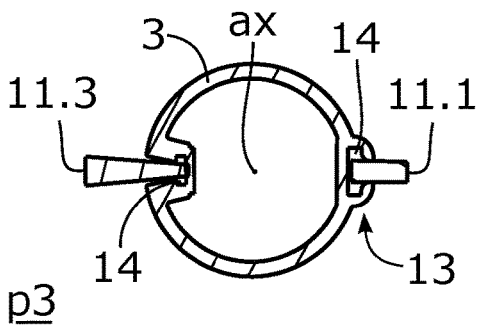
FIG. 3 illustrates a cross section of the brush roll made in a plane indicated in FIG. 1.

FIG. 3 illustrates a cross section of the brush roll 1 made in the plane p3 indicated in FIG. 1. From FIG. 3, it is clear that the bristles 11.3 of the third row of bristles 5.3 are arranged half a turn from the bristles 11.1 of the first row of bristles 5.1.

Figure 4:
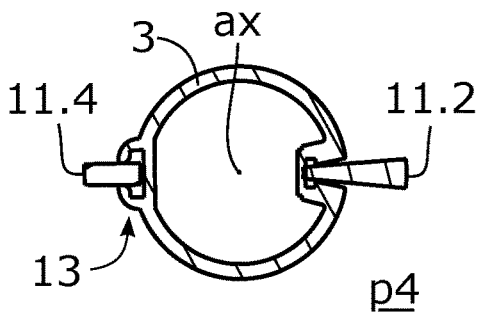
FIG. 4 illustrates a cross section of the brush roll made in a plane indicated in FIG. 1.

FIG. 4 illustrates a cross section of the brush roll 1 made in the plane p4 indicated in FIG. 1. From FIG. 4, it is clear that the bristles 11.4 of the fourth row of bristles 5.4 are arranged half a turn from the bristles 11.2 of the second row of bristles 5.2.

Moreover, as can be seen in FIG. 1-FIG. 4, the first row of bristles 5.1 and the fourth row of bristles 5.4 comprises a first type of bristles 11.1, 11.4. Furthermore, the second row of bristles 5.2 and the third row of bristles 5.3 comprises a second type of bristles 11.2, 11.3. The second type of bristles 11.2, 11.3 has different cleaning characteristics than the first type of bristles 11.1, 11.4. According to the illustrated embodiments, second type of bristles 11.2, 11.3 is softer than the first type of bristles 11.1, 11.4 and extends further from the axis ax than the first type of bristles 11.1, 11.4. Accordingly, the first type of bristles 11.1, 11.4 is harder than the second type of bristles 11.2, 11.3 and extends a shorter distance from the axis ax than the second type of bristles 11.2, 11.3. According to the illustrated embodiments, the first type of bristles 11.1, 11.4 is specifically adapted for cleaning softer surfaces such as carpets, and the like. The second type of bristles 11.2, 11.3 is specifically adapted for cleaning harder surfaces such as floor surfaces, and the like. When cleaning a hard surface, such as a floor surface, the bristles of the second type 11.2, 11.3 will abut against the floor surface. When cleaning a softer surface, such as a carpet, the bristles of the second type 11.2, 11.3 will bend to allow an abutting contact between the surface and the bristles of the first type 11.1, 11.4.

Bristles of the first type 11.1, 11.4 may be harder per se than bristles of the second type 11.2, 11.3. Moreover, bristles of the first type 11.1, 11.4 may each have a greater diameter than the bristles of the second type 11.2, 11.3. As an alternative or in addition, bristles of the first type 11.1, 11.4 may be supported by a support structure 13 protruding from the brush body 3 to increase the force required for bending the bristles of the first type 11.1, 11.4.

As is evident from FIG. 1 and FIG. 2, due to the features of the brush roll 1, one portion of a row of bristles 5.1, 5.4 comprising the first type of bristles 11.1, 11.4 and one portion of a row of bristles 5.2, 5.3 comprising the second type of bristles 11.2, 11.3 will continuously face a surface to be cleaned during rotation of the brush roll 1. Thereby, a low amount of noise is generated by the brush roll 1 during operation thereof. Furthermore, the brush roll 1 will provide a smooth and equal resistance torque during operation of the brush roll 1. Moreover, due to the features of the brush roll 1, the cleaning efficiency is further improved. This because a portion of a surface, such as a floor surface or a carpet, will periodically be faced with bristles of the first type 11.1, 11.4 as well as bristles of the second type 11.1, 11.4.

As indicated above, according to the illustrated embodiments, the brush body 3 comprises a first axial half section 3' and a second axial half section 3", which comprise a respective separate part. Each of the row of bristles 5.1, 5.2, 5.3, 5.4 is arranged on a bristle strip. In an assembling process of the brush roll 1, an assembler may insert the bristle strips into slots 14 arranged in the first and second axial half sections 3', 3". The slots 14 are indicated in FIG. 3. Then the assembler may attach the first and second axial half sections 3', 3", for example using glue. Thus, due to these features, a brush roll 1 is provided having conditions and characteristics suitable for being manufactured and assembled in a cost-efficient manner.

Figure 5:
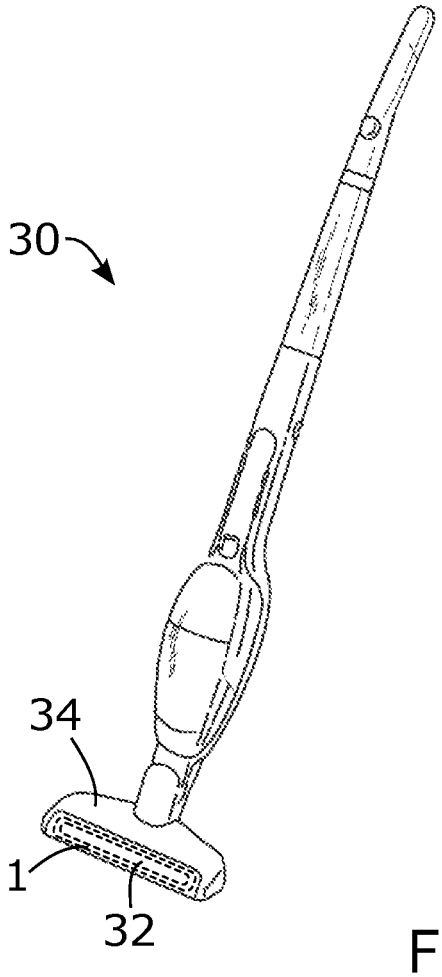
FIG. 5 illustrates a vacuum cleaner according to some embodiments.

FIG. 5 illustrates a vacuum cleaner 30 according to some embodiments. According to the embodiments illustrated in FIG. 5, the vacuum cleaner 30 is a stick-type vacuum cleaner 30. The vacuum cleaner 30 comprises a brush roll 1 according to the embodiments illustrated in FIG. 1-FIG. 4. Moreover, the vacuum cleaner 30 comprises a motor 32 arranged to rotate the brush roll 1 around the axis ax, indicated in FIG. 1-FIG. 4. The motor 32 may be an electric motor 32, or a pneumatic motor arranged to utilize the suction force at a cleaning nozzle 34 of the vacuum cleaner 30. According to the embodiments illustrated in FIG. 5, the motor 32 is an electric motor 32 arranged inside the brush body of the brush roll 1. According to further embodiments, the electric motor 32 may be arranged at a distance from the brush roll 1 and may be connected to the brush roll 1 for example via a belt drive, or the like.

Figure 6:
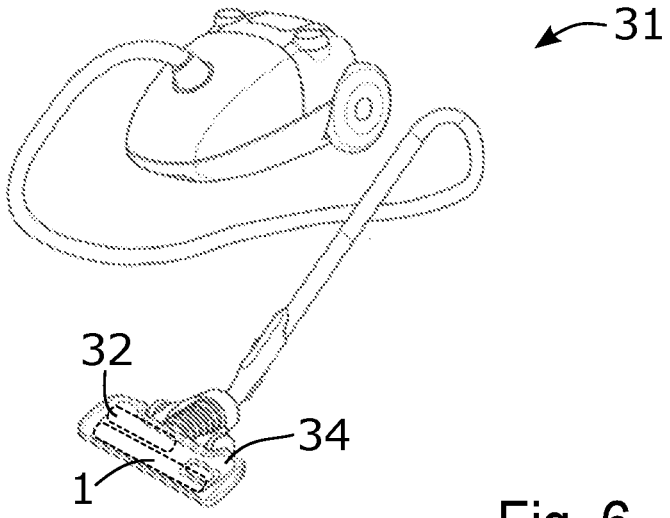
FIG. 6 illustrates a vacuum cleaner according to some further embodiments.

FIG. 6 illustrates a vacuum cleaner 31 according to some further embodiments. The vacuum cleaner 31 comprises a brush roll 1 according to the embodiments illustrated in FIG.

1-FIG. 4. Moreover, the vacuum cleaner 31 comprises a motor 32 arranged to rotate the brush roll 1 around the axis ax, indicated in FIG. 1-FIG. 4. According to the embodiments illustrated in FIG. 6, the motor 32 is a pneumatic motor arranged to utilize the suction force at a cleaning nozzle 34 of the vacuum cleaner 31. However, according to further embodiments, the motor 32 may be an electric motor 32. Such an electric motor 32 may be arranged inside the brush body of the brush roll 1 or may be arranged at a distance from the brush roll 1 and may be connected to the brush roll 1 for example via a belt drive, or the like.

It is to be understood that the foregoing is illustrative of various example embodiments and that the invention is defined only by the appended claims. A person skilled in the art will realize that the example embodiments may be modified, and that different features of the example embodiments may be combined to create embodiments other than those described herein, without departing from the scope of the present invention, as defined by the appended claims.

As used herein, the term "comprising" or "comprises" is open-ended, and includes one or more stated features, elements, steps, components or functions but does not preclude the presence or addition of one or more other features, elements, steps, components, functions or groups thereof.

The invention claimed is:

1. A vacuum cleaner brush roll comprising:
a brush body arranged to rotate around an axis (ax),
a first row of bristles arranged on a first axial half section of the brush body along a first helix around the axis (ax),
a second row of bristles arranged on a second axial half section of the brush body along a second helix around the axis (ax),
wherein a twist direction of the second helix is opposite to a twist direction of the first helix,
wherein the first row of bristles comprises a first type of bristles and the second row of bristles comprises a second type of bristles having different characteristics than the first type of bristles, and
wherein the brush roll is arranged to rotate in an intended rotational direction (rd) causing intersection points between portions of the first and second rows of bristles and a stationary plane (p1) comprising the axis (ax) to move towards a separation plane (p2) between the first and second axial half sections when the brush roll is rotating around the axis (ax) in the intended rotational direction (rd).

2. The brush roll according to claim 1, wherein the second type of bristles is softer than the first type of bristles.

3. The brush roll according to claim 1, wherein the second type of bristles extends further from the axis (ax) than the first type of bristles.

4. The brush roll according to claim 1, wherein the brush roll further comprises a third row of bristles arranged on the first axial half section along a third helix around the axis (ax), and a fourth row of bristles arranged on the second axial half section along a fourth helix around the axis (ax), and wherein a twist direction of the fourth helix is opposite to a twist direction of the first and third helixes.

5. The brush roll according to claim 4, wherein the bristles of the third row of bristles are arranged half a turn from the bristles of the first row of bristles in a plane (p3) perpendicular to the axis (ax), and wherein the bristles of the fourth row of bristles are arranged half a turn from the bristles of the second row of bristles in a plane (p4) perpendicular to the axis (ax).

6. The brush roll according to claim 4, wherein each of the first, second, third and fourth rows of bristles twists approximately half a turn around the axis (ax) along its respective extension.

7. The brush roll according claim 4, wherein the third row of bristles comprises the second type of bristles and the fourth row of bristles comprises the first type of bristles.

8. A vacuum cleaner brush roll comprising:
a brush body arranged to rotate around an axis (ax),
a first row of bristles arranged on a first axial half section of the brush body along a first helix around the axis (ax),
a second row of bristles arranged on a second axial half section of the brush body along a second helix around the axis (ax),
wherein a twist direction of the second helix is opposite to a twist direction of the first helix, and
wherein the first row of bristles comprises a first type of bristles and the second row of bristles comprises a second type of bristles having different characteristics than the first type of bristles, and
wherein the second row of bristles adjoins the first row of bristles.

9. The brush roll according to claim 8, wherein the second type of bristles is softer than the first type of bristles.

10. The brush roll according to claim 8, wherein the second type of bristles extends further from the axis (ax) than the first type of bristles.

11. The brush roll according to claim 8, wherein the brush roll further comprises a third row of bristles arranged on the first axial half section along a third helix around the axis (ax), and a fourth row of bristles arranged on the second axial half section along a fourth helix around the axis (ax), and wherein a twist direction of the fourth helix is opposite to a twist direction of the first and third helixes.

12. The brush roll according to claim 11, wherein the bristles of the third row of bristles are arranged half a turn from the bristles of the first row of bristles in a plane (p3) perpendicular to the axis (ax), and wherein the bristles of the fourth row of bristles are arranged half a turn from the bristles of the second row of bristles in a plane (p4) perpendicular to the axis (ax).

13. The brush roll according to claim 11, wherein each of the first, second, third and fourth rows of bristles twists approximately half a turn around the axis (ax) along its respective extension.

14. The brush roll according claim 11, wherein the third row of bristles comprises the second type of bristles and the fourth row of bristles comprises the first type of bristles.

15. A vacuum cleaner brush roll comprising:
a brush body arranged to rotate around an axis (ax),
a first row of bristles arranged on a first axial half section of the brush body along a first helix around the axis (ax),
a second row of bristles arranged on a second axial half section of the brush body along a second helix around the axis (ax),
wherein a twist direction of the second helix is opposite to a twist direction of the first helix, and
wherein the first row of bristles comprises a first type of bristles and the second row of bristles comprises a second type of bristles having different characteristics than the first type of bristles,
wherein the brush roll further comprises a third row of bristles arranged on the first axial half section along a third helix around the axis (ax), and a fourth row of bristles arranged on the second axial half section along a fourth helix around the axis (ax), wherein a twist direction of the fourth helix is opposite to a twist direction of the first and third helixes, and wherein the third row of bristles comprises the second type of bristles and the fourth row of bristles comprises the first type of bristles.

16. The brush roll according to claim 15, wherein the second type of bristles is softer than the first type of bristles.

17. The brush roll according to claim 15, wherein the second type of bristles extends further from the axis (ax) than the first type of bristles.

18. The brush roll according to claim 15, wherein the bristles of the third row of bristles are arranged half a turn from the bristles of the first row of bristles in a plane (p3) perpendicular to the axis (ax), and wherein the bristles of the fourth row of bristles are arranged half a turn from the bristles of the second row of bristles in a plane (p4) perpendicular to the axis (ax).

19. The brush roll according to claim 15, wherein each of the first, second, third and fourth rows of bristles twists approximately half a turn around the axis (ax) along its respective extension.

* * * * *